US009562199B2

(12) United States Patent
Pereira Almao et al.

(10) Patent No.: US 9,562,199 B2
(45) Date of Patent: Feb. 7, 2017

(54) SYSTEMS AND METHODS FOR CATALYTIC STEAM CRACKING OF NON-ASPHALTENE CONTAINING HEAVY HYDROCARBONS

(75) Inventors: Pedro Pereira Almao, Calgary (CA); Gustavo Luis Trujillo, Calgary (CA); Enzo Peluso, Calgary (CA); Carmen Galarraga, Calgary (CA); Clementina Sosa, Calgary (CA); Carlos Scott Algara, Calgary (CA); Francisco Lopez-Linares, Calgary (CA); Lante Antonio Carbognani Ortega, Calgary (CA); Nestor Gregorio Zerpa Reques, Calgary (CA)

(73) Assignee: NEXEN ENERGY ULC, Calgary, Alberta (CA)

( * ) Notice: Subject to any disclaimer, the term of this patent is extended or adjusted under 35 U.S.C. 154(b) by 384 days.

(21) Appl. No.: 13/535,983

(22) Filed: Jun. 28, 2012

(65) Prior Publication Data

US 2013/0015100 A1 Jan. 17, 2013

Related U.S. Application Data

(60) Provisional application No. 61/503,277, filed on Jun. 30, 2011.

(51) Int. Cl.
*C10G 55/04* (2006.01)
*C10L 1/08* (2006.01)
(Continued)

(52) U.S. Cl.
CPC ..... *C10G 55/04* (2013.01); *C10G 9/36* (2013.01); *C10G 21/003* (2013.01); *C10L 1/08* (2013.01);
(Continued)

(58) Field of Classification Search
CPC ..... C10G 55/04; C10G 21/003; C10G 9/36; C10G 2300/206; C10G 2300/1077; C10G 2300/301; C10G 2300/1059; C10G 2300/308; C10G 2300/302; C10L 1/08
(Continued)

(56) References Cited

U.S. PATENT DOCUMENTS 2,879,224 A * 3/1959 Lawson ..... 208/100
5,688,395 A 11/1997 Carrazza et al.
(Continued)

FOREIGN PATENT DOCUMENTS

CA 2204836 12/2000
CA 2233699 7/2001

OTHER PUBLICATIONS

Pereira, et al., Vision Techologica, vol. 6(1), pp. 5-14, "Aquaconversion: A new option for residue conversion and heavy oil upgrading", 1998.

(Continued)

*Primary Examiner* — Randy Boyer
*Assistant Examiner* — Juan Valencia
(74) *Attorney, Agent, or Firm* — Norton Rose Fulbright Canada LLP

(57) ABSTRACT

This invention relates to systems and methods for catalytic steam cracking of non-asphaltene containing heavy hydrocarbon fractions. The method enables upgrading heavy hydrocarbons to hydrocarbons capable of being transported through pipelines and/or a pretreated step before further treatment in an upgrading refinery, including the steps of separating the heavy hydrocarbon mixture into a light fraction, a full gasoil fraction and a vacuum residue fraction with or without at least partial reduction or asphaltenes; adding a catalyst to the full gasoil and/or to the blend of this with a reduced asphaltenes fraction and subjecting the catalyst-full
(Continued)

gasoil and/or deasphalted oil fraction to catalytic steam cracking to form an effluent stream; separating the effluent stream into a gas stream and a liquid stream; and mixing the liquid stream with the light fraction and the vacuum residue fraction to form an upgraded oil. The system includes hardware capable of performing the method.

14 Claims, 10 Drawing Sheets

(51) Int. Cl.
*C10G 9/36* (2006.01)
*C10G 21/00* (2006.01)

(52) U.S. Cl.
CPC ..... *C10G 2300/1059* (2013.01); *C10G 2300/1077* (2013.01); *C10G 2300/206* (2013.01); *C10G 2300/301* (2013.01); *C10G 2300/302* (2013.01); *C10G 2300/308* (2013.01)

(58) Field of Classification Search
USPC ..... 208/80, 93, 86, 309, 46; 422/187
See application file for complete search history.

(56) References Cited

U.S. PATENT DOCUMENTS

| | | | | |
|---|---|---|---|---|
| 5,688,741 | A | 11/1997 | Carrazza et al. | |
| 5,885,441 | A * | 3/1999 | Pereira et al. | 208/130 |
| 6,030,522 | A * | 2/2000 | Pereira et al. | 208/130 |
| 2008/0166288 | A1 * | 7/2008 | Zhou et al. | 423/586 |
| 2009/0308788 | A1 * | 12/2009 | Lenglet | 208/57 |
| 2011/0198266 | A1 * | 8/2011 | Colyar | 208/86 |

OTHER PUBLICATIONS

Fumoto, et al., Energy & Fuels, vol. 18, pp. 1770-1774, "Recovery of useful hydrocarbons from petroleum residual oil by catalytic cracking with . . . ", 2004.

Loria, et al., Ind. Eng. Chem. Res., vol. 49, pp. 1920-1930, "Model to predict the concentration of ultradispersed particles immersed in viscous media flowing . . . ", 2010.

Columbian Patent Office, Office Action dated Sep. 14, 2015, for Colombian patent application No. 14.009.900 (English translation is attached).

* cited by examiner

SYSTEMS AND METHODS FOR CATALYTIC STEAM CRACKING OF NON-ASPHALTENE CONTAINING HEAVY HYDROCARBONS

FIELD OF THE INVENTION

The present invention relates to systems and methods for catalytic steam cracking (CSC) of low level and/or non-asphaltene containing heavy hydrocarbon fractions to produce upgraded oils (including but not limited to synthetic oils), and novel nano-catalysts for use in said systems and methods, and processes to manufacture said novel nano-catalysts. The present invention may also be applied to bitumen in oil recovery technologies known to a person of ordinary skill in the art, including but not limited to cyclic steam stimulation, steam driven, steam solvent processes, pure solvent process steam-assisted gravity drainage (SAGD) fields, mining and drilling, allowing the creation of upgraded oil, preferably transportable oil.

BACKGROUND OF THE INVENTION

Commonly, heavy oils and bitumen are difficult to transport from their production areas due to their high viscosities at typical handling temperatures. Regardless of the recovery method used for their extraction including costly thermal enhanced oil recovery methods, heavy oils and bitumen generally need to be diluted by blending the oil with low density and low viscosity solvents, typically gas condensate, naphtha and/or lighter oil to make the heavy oils and bitumen transportable over long distances.

As a result, various methods are typically used to make heavy hydrocarbon mixtures transportable. Importantly, as viscosity is the key fluid property to make a heavy hydrocarbon mixture transportable increasing temperature causes significant reductions in the viscosity of heavy hydrocarbons as shown in FIG. 1*b*. As is well known, light oils generally have much lower viscosity values and therefore flow easier through pipelines. As an example, the variation of viscosity of a heavy hydrocarbon mixture with the content of a naphtha diluent is shown in FIG. 1*a*.

Consequentially, there are typically two physical methods that may be used for reducing viscosity to assist in the transportation of heavy hydrocarbons. The first is the application of heat to the hydrocarbons, which reduces their viscosity to such an extent that the mixture can flow through pipelines. As the oil flows in the pipelines, the oil loses heat, and thus, it needs to be constantly warmed. This method is unpractical and very expensive if the heavy hydrocarbon mixture is to travel long distances. The second physical method is dilution, which is the preferred physical method for transporting heavy hydrocarbons over long distances. The disadvantages of dilution are, first, that remoteness makes the construction of pipelines for sending or returning the diluents to the heavy hydrocarbon production zone considerably expensive. The second disadvantage is that the availability of diluents, typically light hydrocarbons, is steadily decreasing since these diluents are fuels by themselves and the reserves of light hydrocarbons are generally being reduced worldwide.

Chemical processing has become more an attractive alternative for making heavy hydrocarbons transportable, and in some cases chemical processing is the only viable alternative to carry heavy hydrocarbon mixtures to refineries and market places. Most chemical processes for making heavy hydrocarbon mixtures transportable are thermal cracking systems. Either moderate cracking such as visbreaking or more severe processes such as coking systems have being proposed. These processes are generally applied to the heaviest hydrocarbons in the heavy hydrocarbon mixture, namely the fraction called the vacuum residue. Both processes reduce the stability of the hydrocarbon mixture due to the increase of the heaviest hydrocarbons called asphaltenes during processing and their tendency to precipitate.

For example, visbreaking is a moderate thermal cracking setup that works at low pressure (~60-120 psi) and relatively moderate temperature (430-480° C.) and reduces the viscosity of heavy hydrocarbon mixtures. The extent or severity of visbreaking is limited by the stability of the asphaltenes.

Other thermal processes generally pose disposal problems due to the relative severity of processing which results in the production of solid hydrocarbons as a byproduct. These thermal processes are generally called coking processes. The fact that these processes produce coke out of about 20-30% weight of the oil produced in the fields limits their applicability due to increased costs and most noticeably, to the environmental impact such quantities of a solid by-product rich in metals and sulfur would cause in remote areas where many of the heavy hydrocarbon reservoirs are located.

Other known chemical processes use catalysts and are also applied to the residual hydrocarbons. For example hydro-processing requires using hydrogen and typically high pressures. Steam catalytic processing of the heaviest hydrocarbons, as described in U.S. Pat. Nos. 5,688,395, 5,688,741, 5,885,441 and Canadian Patent No.'s 2204836 and 2233699, that improve the performance of thermal cracking or visbreaking may make the processed heavy hydrocarbon mixture transportable in terms of viscosity. Nevertheless, steam cracking processes are still limited by the stability of cracked asphaltenes which make the processed heavy hydrocarbon mixtures unstable, jeopardizing the mixtures compatibility with other hydrocarbon streams if sent through pipelines. Similarly to visbreaking, the transportable heavy hydrocarbon mixture from steam cracking of residual hydrocarbons yields poor quality light fractions in refineries and can cause significant fouling in pipelines and vessels during refining, precisely because the heaviest molecules remaining have already been processed.

Dilution is a transportation practice generally unsustainable in the mid/short term due to several reasons, the most noticeable being:

a. Naphtha deficiency is increasing in the zones where many heavy oil production fields are located and in remote zones where new discoveries of these oils are occurring.
b. Availability of light oils for use as diluents is decreasing, paralleling the worldwide trend of conventional oils reserves. Only the high prices of oil provide incentive to transport light oils by blending them with lower quality heavy oils, which helps the latter to get to the markets.
c. The construction and maintenance of long distance diluent pipelines for transporting gas condensate, naphtha or light crude oils is expensive, and is an environmental risk given the flammability of these light hydrocarbons. Any minor leak may lead to explosion and fires with the potential of destroying wildlife and resources. The remoteness of the Heavy oils reservoirs leads to difficult immediate responses to prevent major damages to the environment due to oil ducts leaking. For these and other reasons, high socio-political resistance from remote communities is nowadays generally found wherever oil pipelines are proposed for construction.

d. Heavy oils typically present a high acidity level, which is one of their undesired features along with their poor virgin yields of light fractions in the range of transportation fuels. Acidity is caused by the presence in these oils of naphthenic acids, which are hydrocarbons containing chemical functionalities that involve carboxyl and sulfide compounds able to release extremely labile protons at moderate temperatures. This ability promotes corrosion once in contact with metallic walls such as those of pipelines and at processing, upgrading and/or refinery units. Acidity in heavy oils is not destroyed by dilution. At present, no effective low temperature chemistry to neutralize heavy oils acidity has been found that doesn't generate additional or insurmountable difficulties. Acidity is relatively easy to destroy under conventional upgrading processing, where hydrotreating or hydrocracking of vacuum gas oils takes place and/or hydro or thermal processing of the residues occurs.

e. In heavy oils-diluent blends, stability may be an issue in some cases, specifically for heavy oils that contain a significant proportion of asphaltenes, which is the fraction of heavy hydrocarbons that precipitates in the presence of light paraffins. If the diluent (gas condensates, naphtha or light oil) is rich in light paraffins and the heavy oil is rich in asphaltenes or is predominantly constituted of highly aromatic asphaltenes, the heavy oil-diluent blend will be prone to precipitate whenever a slight variation in solubility occurs, either in pipelines or storage tanks or both. Remarkably, light crude oil asphaltenes are typically less stable than the ones in heavy oils, thus they may tend to first precipitate over those in heavy oils when blends of light and heavy crude oils are produced for transporting the latter.

In remote zones where scarcity of diluents for large heavy oil reservoir developments already exists, the construction of upgraders in the nearby area has generally been found to be a good solution both technically and economically. The upgraders in Northern Alberta, Canada are one example of extended heavy oils reserves where there is a lack of light oils available in the vicinity. Enormous costs have been incurred to produce upgrading in the Northern Alberta area to date and there is still a need for different technological solutions to reduce the costs of new upgraders to develop the vast majority of the still unexploited reserves of bitumen located in this remote area. Similar constraints exist for the extra heavy oil present in the Orinoco basin in Venezuela, and other heavy oil reservoirs throughout the world In many other locations worldwide where medium/small heavy oil reservoirs are being exploited, generally no viable technological and economical solution has been developed to overcome the problems of dilution. The up-scaling benefits of conventional upgraders cannot be captured since many reservoirs are not rich enough to justify investments in upgraders, even though the reservoirs may be very economically attractive for exploitation. Additionally, many of these reservoirs are placed in difficult, far away geographies, and at times are located within environmentally protected areas where large developments beyond certain limits and/or release/accumulation of significant quantities of waste are intolerable.

Field Upgrading: Transcending Dilution Limitations

Most upgrading technologies commercially offered or installed are adaptations from refinery environments with a few modifications to fit them into facilities and service restrictive environments. These upgraders, very much like in the current most efficient deep conversion refineries, transform the vacuum residual fraction, the one that remains undistilled under a vacuum at atmospheric equivalent temperatures typically higher than 560° C. or even lower. Residue constitutes usually higher than 30 wt % of the heavy oil, typically higher than 50% in extra heavy oil and bitumen such as the ones in Northern Alberta, Canada, or in Northern Orinoco area in Venezuela. But unlike upgraders, refineries for which the current residue upgrading processes were developed are mostly placed in industrialized areas with abundant utilities and services. Refineries have a wide variety of transporting options and access to disposition alternatives; upgraders usually do not have all these advantages.

Typically, transportable oil requires a minimum API gravity and viscosity. For example, in Canada, commercial pipelines require a minimum 19° API and 350 centistokes at the pipeline reference temperature. Other regions will have other requirements which take into account location as well as climate/seasonal conditions The situation of most of the newest and undeveloped heavy oil fields imposes rethinking heavy oils upgrading in such a way that transportable oil can be reached with energetic and environmental efficiency and relative low complexity yet low investment costs.

Thus, solutions are needed for all cases mentioned above in which there is no (or there is limited) economic viability for conventional scale upgrading, and/or in which a minimization of the environmental impact of the upgrading activity is required, and for cases where limited or no availability of diluent exist, which are becoming more and more common.

A review of the prior art reveals that U.S. Pat. Nos. 5,688,395, 5,688,741 and 5,885,441 published a residual processing that uses a chemistry valuable for moderated heavy oils upgrading (Thermo-Catalytic Steam Cracking). These processes use low-pressure steam dissociation applicable to alkyl aromatics present in the residual fraction. This technology reduces the residual fraction, while producing light hydrocarbon fractions to result in a moderate upgrading in the range of 14-15° API from the typical 8-10° API originally in the bitumen or extra heavy oil of the examples shown in these patents. The same chemistry is applicable to distillable gasoil fractions existing in heavy oils, as established in U.S. Pat. No. 6,030,522. In this technology, the process claimed is inserted upstream of a fluid catalytic cracking (FCC) unit, in a configuration typical of a conversion refinery.

In the technologies of the prior art discussed above, with residual processing, the improvement obtained is achieved at the expense of deteriorating the stability of the post-processed oil. In fact it is generally the stability of asphaltenes in the converted residual that limit the performance of the process. As the conversion of the residual arrives at levels higher than 35 wt % for some residuals, or higher than 40 wt % in other crude oils, the stability of asphaltenes approaches tolerance limits established for transportation of heavy fuels and residual fuels. P-value is one of many stability scales used as indicative of the stability of the residual fuel or heavy oil. It establishes that when processed oil reaches a P-value of 1, it is unstable; a safe P-value limit is usually set between 1.15 and 1.25. For virgin heavy oils, P-values are usually around 2.5-2.8 or even higher. For virgin light oils P-values are lower, below 2 in many cases, with virgin Arabian light crude oils presenting values around 1.7. A low P-value in an unprocessed oil means that the residue can only be moderately thermally cracked to produce a low conversion of the residual before the instability onset is reached (P-value lower than 1.15).

Asphaltene stability loss during cracking of residuals considerably affects the options of many technologies for field upgrading of heavy oils exploited from remote reservoirs of heavy oils. For instance, thermo-catalytic steam cracking (CSC) of residuals requires the process to be used at its highest severity limits to meet transporting requirements. Even if a heavy oil were recessed by catalytic steam cracking to reach 14-15° API under the scheme of the U.S. Pat. No. 5,885,441 and the required transporting viscosity (typically lower than 350 cP), these oils would have been processed at the stability limit. Crude oil close to instability is affected in pipeline transportability due to the high potential of sediment formation within the pipelines and to blending limitations since any contact with paraffinic oil could induce precipitation of asphaltenes. Furthermore, as the field-upgraded oil produced would need to go to refineries, additional problems of stability would result in these facilities that could limit the uptake of such oil at the refinery site, as for example excessive fouling in heat exchangers and furnace coils and solid deposits inside distillation columns.

SUMMARY OF THE INVENTION

In accordance with the invention, there is provided a process for upgrading heavy hydrocarbon mixtures comprising the steps of:

a. separating the heavy hydrocarbon mixture into a light fraction, a full gasoil fraction and a vacuum residue fraction;
b. adding a catalyst to the full gasoil fraction and subjecting the catalyst-full gasoil fraction to catalytic steam cracking to form an effluent stream;
c. separating the effluent stream into a gas stream and a liquid stream; and
d. mixing the liquid stream with the light fraction and the vacuum residue fraction to form an upgraded oil.

In further embodiments, the process may include between step c) and d) the steps of:

a. deasphalting the vacuum residue fraction from step a) to form a deasphalted fraction and an asphaltene-rich fraction;
b. adding a second catalyst to the deasphalted fraction and subjecting the deasphalted fraction to catalytic steam cracking to form a light product stream;
c. separating the light product stream into a second gas stream and a second liquid stream; and wherein the asphaltene-rich fraction comprises the vacuum residue used in step d) to form an upgraded oil.

In a further embodiment, the effluent stream is separated in step c) by hot separation.

In another embodiment, the process includes the step of splitting the vacuum residue fraction from step a) into at least two vacuum residue streams, wherein a first vacuum residue stream is used as fuel and a second vacuum residue stream comprises the vacuum residue fraction in step d) that forms the upgraded oil.

In another embodiment, the process includes the step of splitting the asphaltene-rich fraction from step i) into at least two asphaltene-rich streams, wherein a first asphaltene-rich stream is used as fuel and a second asphaltene-rich stream comprises the vacuum residue fraction in step d) that forms the upgraded oil.

In further embodiments, the process includes the step of recovering the catalyst from step b) and/or recovering the second catalyst from step ii). The catalyst may be recovered by hydrostatic decanting.

In another embodiment, the heavy hydrocarbon mixture is selected from any one or a combination of the following: heavy crude oils, distillation residues and bitumen.

In another embodiment, the heavy hydrocarbon mixture is deasphalted, preferably solvent deasphalted and subjected to catalytic steam cracking.

In yet another embodiment, the process is applied to any oil recovery technologies known to a person of ordinary skill in the art, including but not limited to cyclic steam stimulation, steam driven, solvent steam processes, pure solvent processes, SAGD, mining and drilling, allowing the creation of an upgraded oil, preferably transportable oil.

In further embodiments, the upgraded oil has a API gravity of equal to or greater than 15° API and/or the upgraded oil has a viscosity of equal to or less than 350 cP at 25° C.

In one embodiment, the full gasoil fraction has an initial boiling point (IBP) between 210 and 570° C.

In another embodiment, the catalyst is a fixed bed catalyst or a nano catalyst.

In a further embodiment, the catalyst comprises any one or a combination of the following: rare earth oxides, group IV metals, NiO, CoOx, alkali metals and $MoO_3$ and/or the particle size of the catalyst is equal to or less than 250 nm and/or equal to or less than 120 nm.

In another aspect, the invention provides a process for upgrading heavy hydrocarbon mixtures comprising the steps of:

a. separating the heavy hydrocarbon mixture into a light fraction and a topped heavy oil;
b. deasphalting the topped heavy oil fraction from step a) to form a deasphalted fraction and an asphaltene-rich fraction;
c. adding a catalyst to the deasphalted fraction and subjecting the catalyst-deasphalted fraction to catalytic steam cracking to form an effluent stream;
d. separating the effluent stream into a gas stream and a liquid stream, forming an upgraded oil optionally
e. mixing the liquid stream from step d) with the light fraction from step a), forming an upgraded oil, and further optionally mixing the liquid stream from step d) with the light fraction from step a) and the asphaltene-rich fraction from step b) to form an upgraded oil.

Furthermore, the asphaltene-rich fraction from step b) may be treated separately for use in any of the following i) disposal; ii) fuel; and iii) feed for other processes, and combinations thereof.

In another aspect, the invention provides a system for upgrading heavy hydrocarbon mixtures comprising:

a crude distillation unit for separating the heavy hydrocarbon mixture into a light fraction, a full gasoil fraction and a vacuum residue fraction;
a catalytic steam cracking reactor for cracking the full gasoil fraction with a catalyst in the presence of steam to form an effluent stream;
a first hot separator for separating the effluent stream into a first gas stream and a first liquid stream; and
means for combining the first liquid stream with the light fraction and the vacuum residue fraction to form an upgraded oil.

In another embodiment, the system includes:

a solvent deasphalting unit for deasphalting the vacuum residue fraction to form a deasphalted fraction and an asphaltene-rich fraction, wherein the asphaltene-rich fraction is added to the upgraded oil;

a second catalytic steam cracking reactor for subjecting the deasphalted fraction to catalytic steam cracking to form a light product stream; and a second hot separator for separating the light product stream into a second gas stream and a second liquid stream, wherein the second liquid stream is added to the upgraded oil.

In another embodiment, the system includes a hydrostatic decanting unit for recovering the catalyst from the liquid stream of step c) and/or a catalyst preparation unit for preparing the catalyst to be used in the catalytic steam cracking reactor and/or a splitter for splitting the vacuum residue into two streams: a first stream to be used as fuel and a second stream that comprises the vacuum residue fraction that forms part of the upgraded oil.

In yet another aspect, the invention provides a system for upgrading heavy hydrocarbon mixtures comprising:

a topping unit for separating the heavy hydrocarbon mixture into a light fraction and a topped heavy oil;

a solvent deasphalting unit for deasphlating the topped heavy oil fraction from step a) to form a deasphalted fraction and an asphaltene-rich fraction;

a catalytic steam cracking reactor for cracking the deasphalted fraction with a catalyst in the presence of steam to form an effluent stream;

a hot separator for separating the effluent stream into a gas stream and a liquid stream; and means for combining the liquid stream with the light fraction and the asphaltene-rich fraction to form an upgraded oil.

In yet another aspect, this invention provides the application of catalytic steam cracking to a hydrocarbon feed having a low level of asphaltene, wherein said low level of asphaltene enables the catalytic steam cracking to result in a product that is upgraded oil, preferably transportable oil. The asphaltene level is crude dependent. Preferably the asphaltene level in a naphthenic oil hydrocarbon feed is reduced by about at least 30% of the original heavy oil asphaltene content. Preferably the asphaltene level in a non-naphthenic oil hydrocarbon feed is reduced by about at least 40% of the original heavy oil asphaltene content.

According to another aspect of the invention, there is provided a process of upgrading heavy hydrocarbons from a reservoir, said process comprising:

i) reducing the content of asphaltene in said heavy hydrocarbon;

ii) treating the product of step i) to catalytic steam cracking; and iii) distilling said cracked product of step ii) and recovering an upgraded heavy hydrocarbon.

According to another aspect of the invention, any of the processes disclosed herein are used to upgrade deasphalted or partially deasphalted oil (DAO).

According to yet another aspect of the invention, any of the systems disclosed herein is used in upgrading oil from oil recovery technologies known to a person of ordinary skill in the art, including but not limited to cyclic steam stimulation, steam driven, steam solvent processes, pure solvent process, SAGD, mining and drilling.

According to yet another aspect of the invention, there is provided a nano-catalyst, for use in catalytic steam cracking, wherein said nano-catalyst has a particle size of from 20 to about 120 nanometers, preferably said nano-catalyst is comprised of metal selected from rare earth oxides, group IV metals, and mixtures thereof in combination with NiO, CoOx, alkali metals and $MoO_3$.

According to yet another aspect of the invention, there is provided a process to manufacture said nano-catalyst, said process comprising the steps of: pre-mixing an alkali solution selected from an inorganic or organic with a transition metal salt, selected from an inorganic salt or an organo-soluble salt, forming a stream enriched in both metals; high energy mixing resulting in an emulsion and decomposition to form a nano-dispersion of the nano-catalyst.

BRIEF DESCRIPTION OF THE DRAWINGS

The invention is described with reference to the accompanying figures in which.

DETAILED DESCRIPTION OF THE INVENTION

In accordance with the invention and with reference to the figures, systems and methods for catalytic steam cracking of low and/or non-asphaltene containing heavy hydrocarbons are described.

Figure 1A:
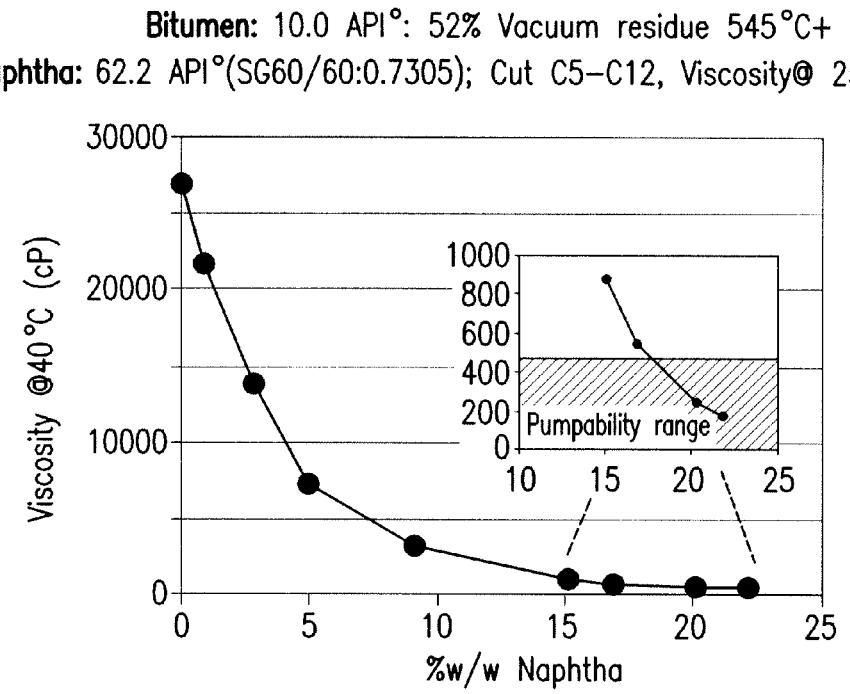
FIG.1A (Prior Art)
FIG. 1*a* is a graph showing the effect of diluent concentration on the change of viscosity of heavy oils.
Figure 1B:
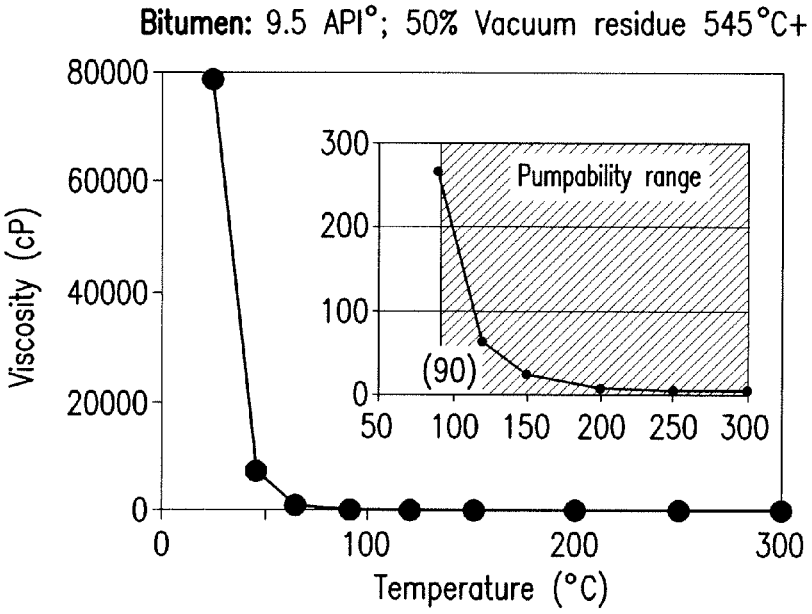
FIG.1B (Prior Art)
FIG. 1*b* is a graph showing the effect of temperature on the change of viscosity of heavy oils.
Figure 2:
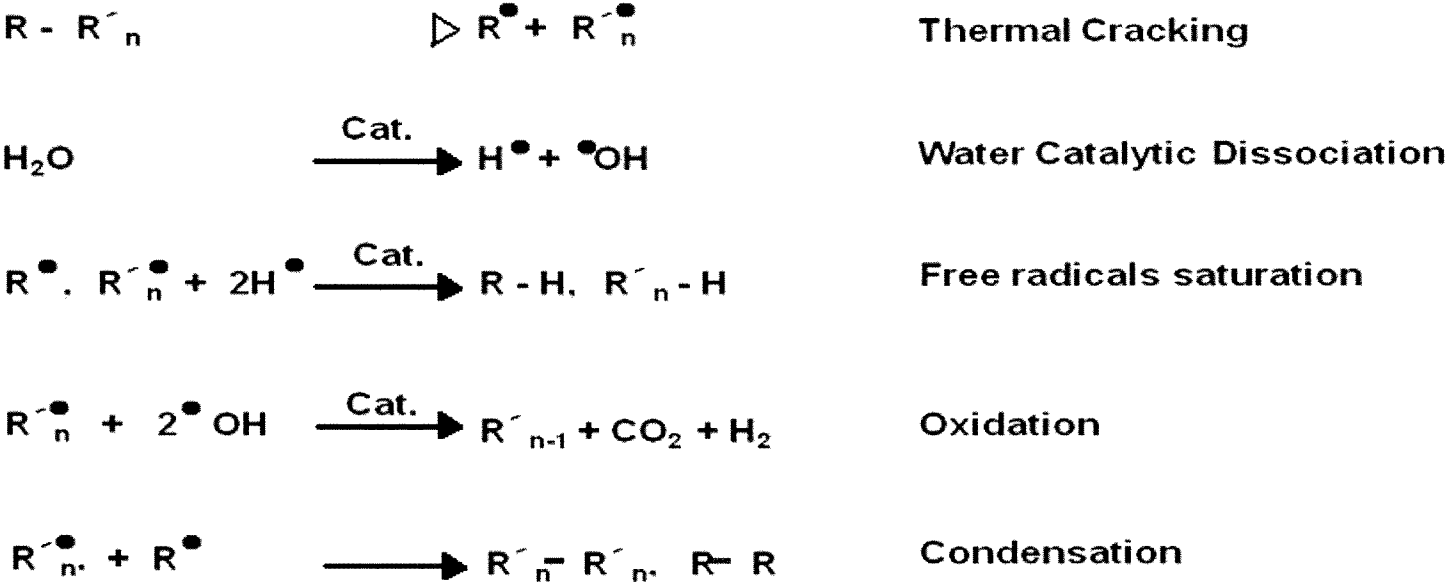
FIG. 2 is a reaction scheme of thermo-catalytic steam cracking (CSC)

More specifically, the processes of this invention proceed by incorporating within thermal cracking processes, a chemistry path that intercepts the heaviest free radicals. By this methodology, these radicals are neutralized before they polymerize and become extremely heavy to remain suspended in the liquid media. In the context of the invention, this reaction path is termed 'Thermo-Catalytic Steam Cracking' (hereafter referred to as CSC). The scheme shown in FIG. 2 represents the global mechanism of the methodology, which can be applied to the processing of any heavy hydrocarbon fraction with similar results but different progression limits of the reaction.

A similar mechanism has frequently been written for hydro processing, only that instead of water the hydrogen is dissociated (by the hydro processing catalysts), thus saturating the thermally formed free radicals to produce stable molecules of lower molecular way and minimizing condensation reactions.

Figure 3:
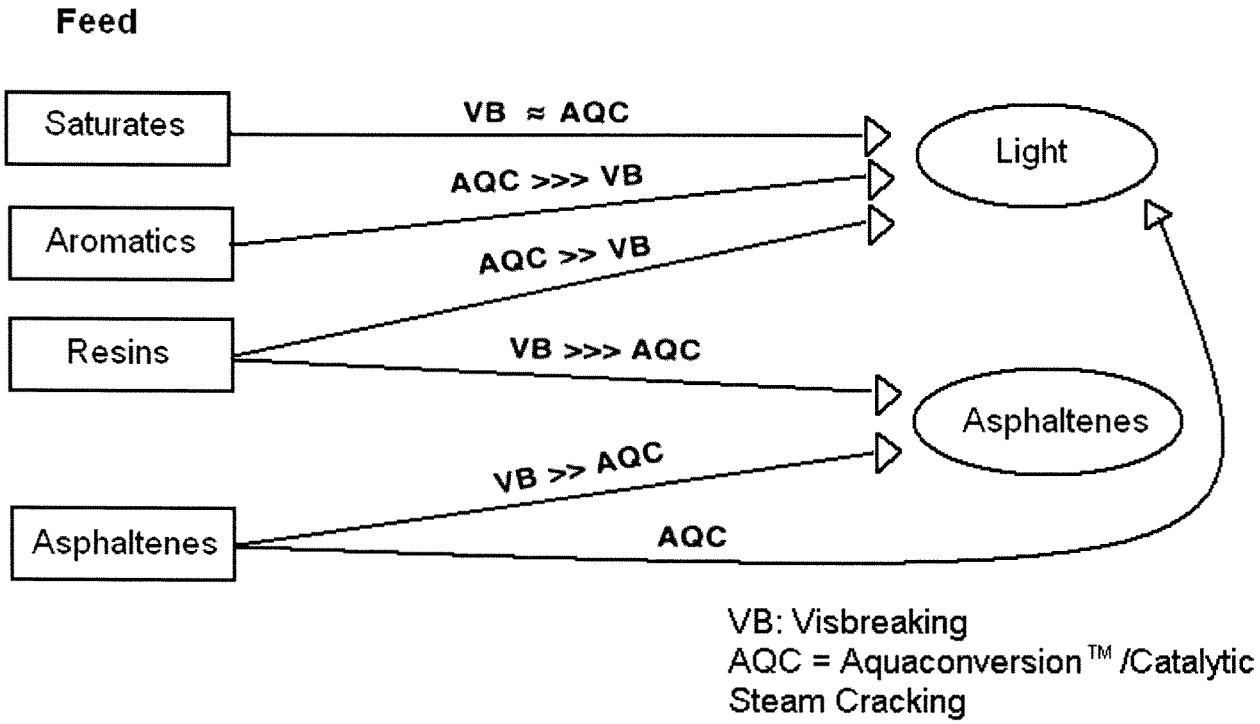
FIG. 3 is a flow chart showing the gross molecular transformation for an Aquaconversion™/thermo-catalytic steam cracking process.

From detailed studies previously published using vacuum or atmospheric residues as feedstock (Vision Tecnol. 1998, 6, 5-14 and Energy & Fuels 2004, 18, 1770-1774), the use of catalyst and steam increase alkyl-aromatics and resins/asphaltenes conversion while reducing overall thermal condensation (Asphaltene/coke deposits). FIG. 3 qualitatively shows the gross molecular transformations that occur by applying CSC techniques to vacuum residues.

Figure 4:
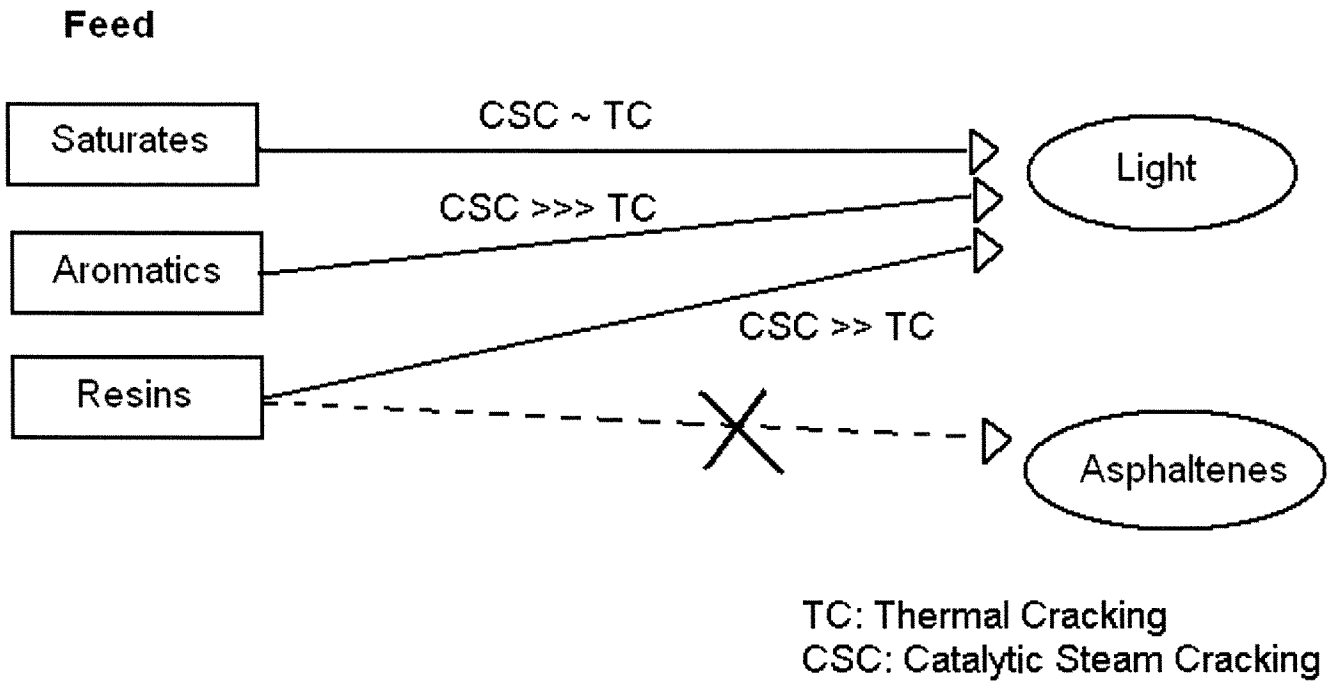
FIG. 4 is a flow chart showing the gross molecular transformation for a thermo-catalytic steam cracking process applied to fractions not containing asphaltenes.

For Vacuum Gas Oil (VGO), the use of catalyst and steam increases alkyl-aromatics and resins conversion with minimal thermal condensation (coke deposits) and minimal production of asphaltenes as illustrated in FIG. 4.

Processing schemes that overcome the limitations of catalytic steam cracking for use during field upgrading of heavy oils are thus described herein.

Bitumen fractions have been tested with boiling points ranging between 220 and 560° C., such as Atmospheric Gasoil (AGO) and Vacuum Gasoil (VGO), and it has been found that these are susceptible of sufficiently being converted to produce light distillates that contribute to reaching transportable oil.

An additional configuration of this invention includes processing along with the atmospheric and vacuum gas oil (A&VGO) the Deasphalted oil from SDA processing of the vacuum residue. Yet another configuration of this invention includes directly catalytic steam cracking processing the DAO (Deasphalted Oil) produced by SDA (Solvent Deasphalting) of the heavy oil topped from the 250° C. fraction.

This invention also provides upgrading solutions for the cases mentioned above in which there is no (or there is limited) economic viability for conventional scale upgrading, and/or in which a minimization of the environmental impact of the upgrading activity is required, and for the cases of limited or no availability of diluents exist.

The processes described herein provide a solution to the above-described situation with the following objectives:

a. One object of this invention is to upgrade heavy oils without directly tackling the residual fraction as most current upgrading technologies do. This concept avoids processing the residue if it is not needed, thus also avoiding processing asphaltenes that are present in the residue. Instead, the subject methods process the full range gas oil fraction, which includes both atmospheric gas oil and vacuum gas oil. If needed to achieve transporting viscosity levels, the residual fraction is deasphalted before processing the low and/or non-asphaltenic fraction of that residue.
b. The present methods use an uncommon chemical hydrocarbon cracking path, catalytic steam cracking, in which natively-generated hydrogen allows for the possibility of mild hydrogenation, thus significantly reducing the typical production of olefins and poly-aromatics of thermal cracking. Unsaturated products generally cause instability and therefore processed streams must be hydrotreated before transporting the upgraded crude oil. Thus skipping hydrotreating of the light fractions at the upgrading site considerably reduces investment and operating costs, but very importantly, makes it unnecessary to carry natural gas to the upgrading zone. It also makes it unnecessary to gasify residual hydrocarbon fractions, which considerably decreases $CO_2$ emissions.
c. The reaction path enables reactions to occur in a controlled manner, targeting no solids production to avoid handling solid coke at the upgrading area.
d. The processes enable a high stability asphaltenes to be present in the produced oil during processing. This is obtained by not processing the fraction containing asphaltenes and making eventual use of this fraction for fuel within the upgrading facilities by remixing the non-used portion with the upgraded products.
e. The methods enable the use of a portion of vacuum residue or asphaltenes for the fuel needs of processing which also contributes to the independence of natural gas which is very desirable for remote upgrading. This also increases the transportability of the resulting oil, as vacuum residue, particularly asphaltenes, are the major contributors to the low viscosity of heavy oils and bitumen.
f. Yet another target of this invention is to make the facilities for remote heavy oil upgrading sufficiently simple, while performing the chemical transformation sufficient to produce a pipeline transportable crude oil with less than 350 cP and a gravity from 15° API or more to 18° API or more. The API gravity value depends on the nature of the heavy oil or bitumen processed and on the upgrading scheme selected from the ones proposed herein, which are all based on non-asphaltenes processing.

The heavy oil upgrading process deals with the chemical transformation of either the distillable gas oil fractions (GO) or the solvent deasphalted fractions (DAO) from the heavy oil, or with both. Upgrading solutions have not so far considered the catalytic steam cracking (CSC) transformation of GO or combinations of GO and DAO. The GO fraction in heavy oils is almost as abundant as residuals in heavy oils, and in some particular heavy oils is even larger than the residual fraction. The subject processes ensures stability of light products to secure pipeline acceptance since no significant proportions of olefins are produced. This is due to the type of chemistry used in the GO conversion unit, which uses catalytically activated water (steam) to both hydrogen saturate and oxidize the primary carbons thermally ruptured. The subject processes take advantage of the richness of some heavy oils in Vacuum Gas Oil (VGO) and in Deasphalted oil (DAO); using the acidity in this stream, which is typically higher than in residue, for the processing. This results in the production of a low acidity upgraded crude oil.

The processes of this invention use a low residence time catalytic processing that lowers the energy requirements of upgrading when compared to conventional coking or hydro processing used in conventional upgraders. The schemes of this invention are suitable for making the heavy hydrocarbon mixtures transportable by eliminating or substantially reducing the need for dilution, which is typically used for transporting heavy hydrocarbon mixtures as described above. Furthermore, the subject process schemes produce the diluent needed for transportation of the heavy hydrocarbon mixture out of the middle distillate and/or the deasphalted fractions of the heavy hydrocarbon mixture.

The subject methods provide: (i) process schemes, that are based on the use of water in the form of steam as a reactant and of catalysts, preferably nano-catalysts, to produce transportable hydrocarbon mixtures without having to process the residual fraction or the heaviest asphaltenic fraction of the heavy hydrocarbon mixture; (ii) process to provide process schemes that generate stable diluent out of the gasoil fraction of heavy hydrocarbon mixtures and not from the residual heaviest fraction. Said gasoil feed is an intermediate range of hydrocarbons, usually called middle or atmospheric and heavy or vacuum distillates. These heavy distillates are lighter than the heaviest or residual hydrocarbons targeted by the prior art's thermal or catalytic processes.

The gasoil stream subject of the chemical process of this invention is then an original 'cut' made of both atmospherically distillable gasoil and vacuum distilled gasoil, and it will be referred to as "full range gasoil" herein.

The invention will be further understood with references to the drawings.

Figure 5:
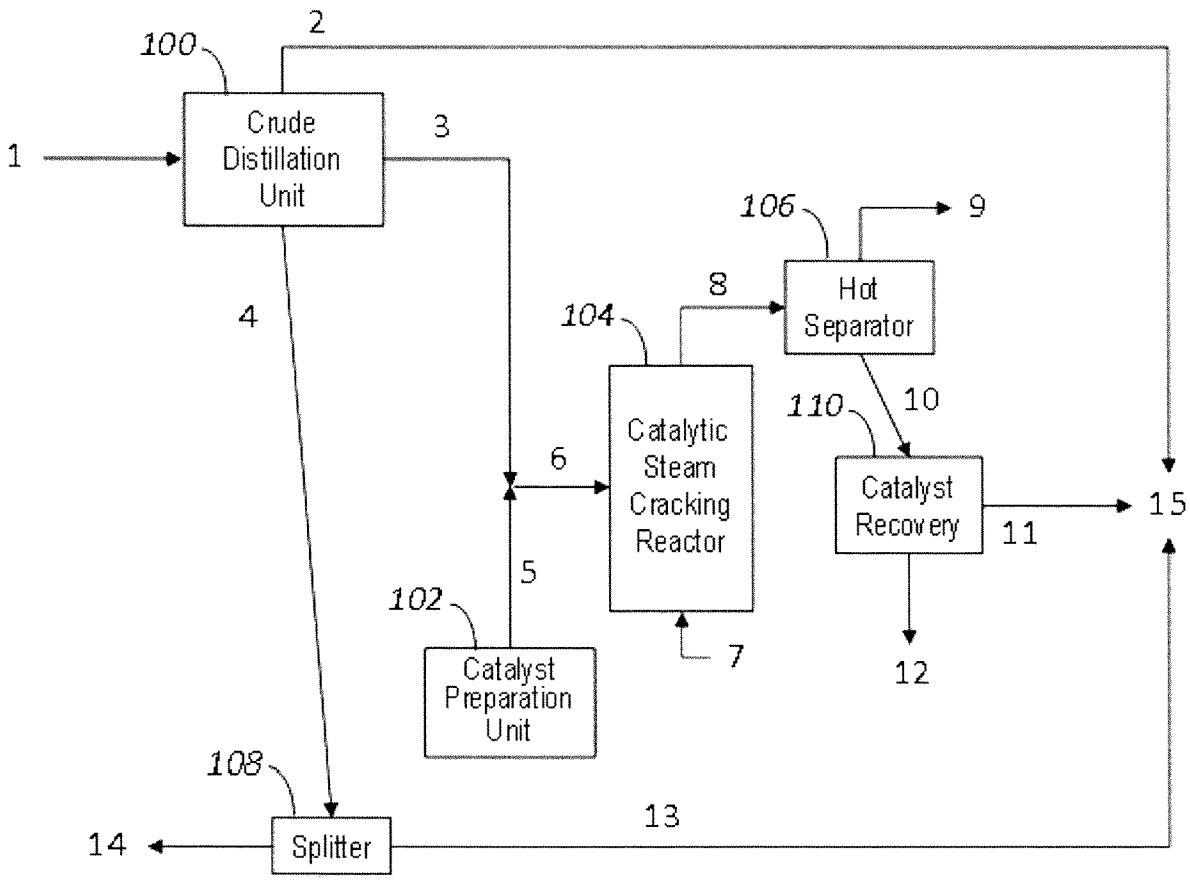
FIG. 5 is a block diagram showing a process according to one embodiment of the invention for the processing of heavy oils and/or bitumens including feedstock production (distillation) followed by CSC.

Referring to FIG. 5, the heavy hydrocarbon mixture (1), which can include heavy oils and/or bitumens, is passed through a crude distillation unit (100) that separates the heavy hydrocarbon mixture for the proposed processing, thus releasing three streams: by the top, the light fraction IBP-250° C. (2); from the bottom, the vacuum residue (VR) fraction>540° C.$^+$ (4); and all the middle distillates produced which constitute what is named the full gasoil fraction (3). The full gasoil fraction (3) is in the approximate range of 250-540° C. The IBP of the full range gasoil fraction may vary from 210 to 280° C. and its final boiling point from 480 to 570° C. The residue fraction is divided (108) into two streams: fuel (14) and VR for recombination (13). Once separated in the crude distillation unit, said gasoil fraction is combined with a catalyst (5) from the catalyst preparation unit (102) to be processed in the catalytic steam cracking reactor (104). In the catalytic steam cracking reaction (104), the gasoil is cracked in the presence of steam (7) and either a fixed bed catalyst or a nano size catalyst to generate significant proportions of light hydrocarbons or diluent. Effluents from the reactor (8) will be directed to a hot separator (106), wherein gases (9) and liquid products (10) are separated. If using dispersed catalysts the liquid stream may be processed (110) to recover the catalytic species. After the reaction and conditioning, the liquids from reaction (11) are combined with lights (2) and VR (13) to form the synthetic upgraded oil (SUO) in stream 15.

Figure 6:
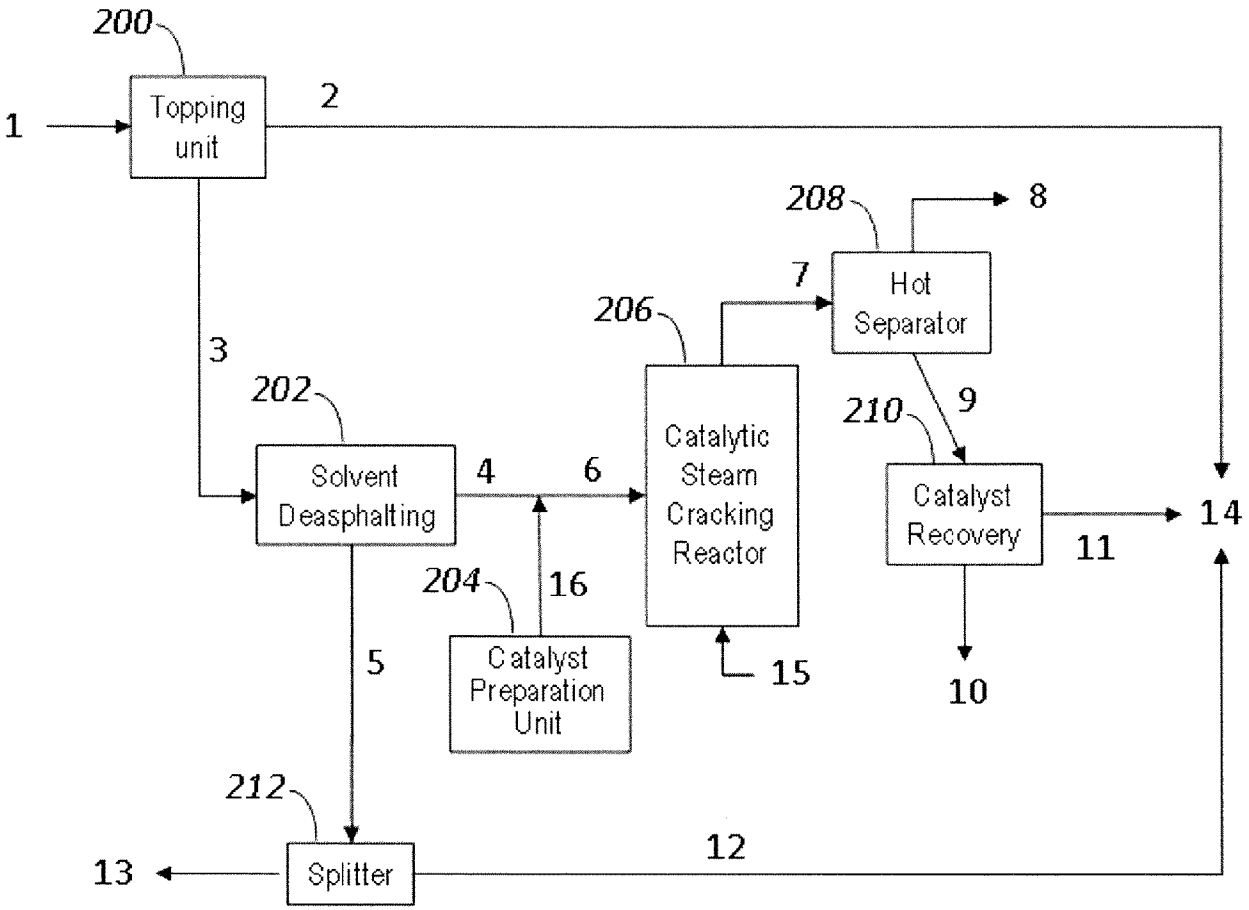
FIG. 6 is a block diagram showing a process according to one embodiment of the invention for the processing of heavy oils and/or bitumens including feedstock production (distillation plus deasphalting) followed by CSC.

Turning now to FIG. 6, in this embodiment a topping unit (200) is employed to separate the heavy hydrocarbon feed (1) into two streams: the light fraction IBP-250° C. (2) and the topped heavy oil (3) that can be processed in a solvent deasphalting unit (202) to separate said topped oil into a deasphalted oil (DAO) fraction (4) and an asphaltene-rich fraction (5). The operation of the deasphalting unit can be adjusted to select the properties and contents of the DAO and the asphaltene-rich fractions as needed. The DAO fraction is then processed in a catalytic steam cracking reactor (206) and finished as in the process of FIG. 5. The asphaltene-rich fraction is divided into fuel (13) and pitch (12) that can be combined with the lights (2) and the liquid upgraded products (11) to constitute the synthetic upgraded oil (14).

Figure 7:
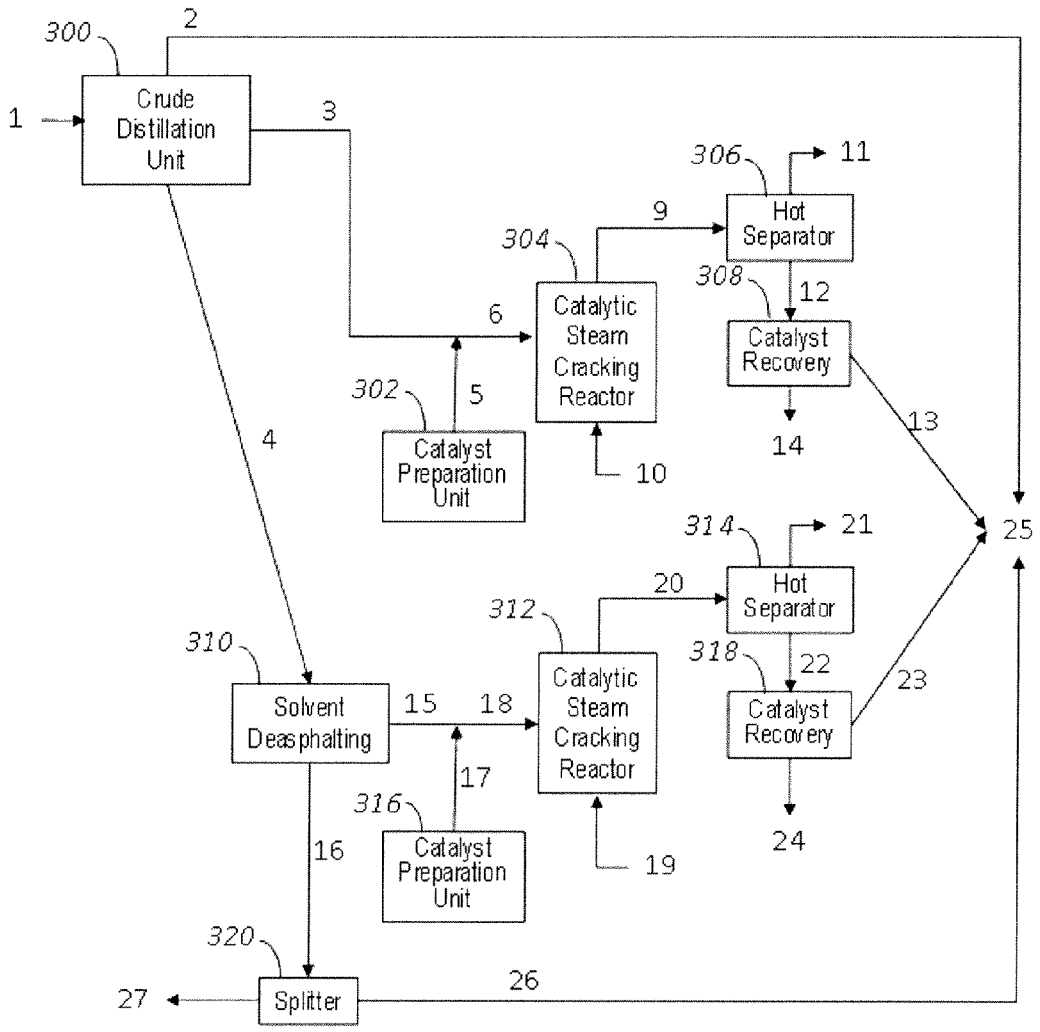
FIG. 7 is a block diagram showing the process of FIG. 5 including a deasphalting step of the vacuum residue fraction before the CSC processing in accordance with one embodiment of the invention.

Now referring to FIG. 7, the heavy oil mixture (1) is fractionated in a crude distillation unit (300) similar to the processing described in FIG. 6; however the bottom stream of the vacuum residue (VR) fraction (4) goes to a solvent deasphalting unit (310) to produce: a) an asphaltene-rich fraction (16) that is split into two streams; one stream to be used as fuel (27) and a second stream to be combined into the synthetic upgraded oil (SUO) pool; and b) a deasphalted fraction (15) that will be merged with a catalyst and processed in the catalytic steam cracking reactor (312) to where steam (19) will be injected and light products will be generated (20). A hot separator unit (314) and a catalyst recovery unit (318) complement this stage of the process for proper treatment and cleaning of said products. Clean products from this processing step (23) will join clean products from the middle distillates CSC processing step (stream 13), the lights produced during the fractionation process (2), and the stream 26 to form the SUO (25). Middle distillates fraction (3) will be processed accordingly to the referred processing described in FIG. 6 to yield stream 13.

After processing in the gasoil conversion unit and/or in the DAO conversion unit, the entire liquid product from processing is stripped of gases in a hot separator unit, the design of that unit is such that hydrogen from the gas stream effluent from the process is kept in a recycle loop and used to strip out gases from the liquid stream as well as to saturate potential olefins to form paraffins. The fact that a transition metal is used in the catalyst nano-dispersed formulation and that it is present with the liquids in the hot separator allows for mild hydrogenation to happen in that unit, both eliminating potential instability in the light products as well as performing a moderate hydrodesulfurization of said stream.

Once the liquids from the gasoil converter exit the hot separator unit they are washed with water and decanted in a conventional hydrostatic decanting unit to separate the nano-dispersed catalyst particles. This concept is economical and an original practical step for separating nanodispersed catalyst from a light hydrocarbon stream.

As shown in the prior art, steam cracking of residual heavy hydrocarbons also uses a separation setup such as hydrostatic desalters. However, a large hydrocarbon density gap with respect to that of water is important for easing this processing. The density of a heavy hydrocarbon cracked mixture is higher than the density of the gasoil or the DAO cracked mixture. The density of heavy hydrocarbons is much closer to the density of water, while the density of light and middle distillates such as the ones coming from steam cracking of full range gasoil or from DAO which doesn't contain asphaltenes, is much lower than the density of water, therefore making the catalyst separation easier for the processes of this invention than with the processing used in previous art.

TABLE 1

Comparison of hydrocarbons densities

| Hydrocarbon | Density, g/ml |
|---|---|
| Processed VGO | 0.9321-0.9352 |
| Processed DAO | 0.9725 |
| Bitumen | 1.0001 |
| Water | 0.9999 |
| Light distillates (IBP-343° C.) | 0.8609 |
| AGO-VGO feedstock | 0.9565 |
| Vacuum residue | 1.0603 |

As mentioned, the catalyst nano-particles after reaction can be separated by extraction from the oil performed in electrostatic water-oil separators (desalting). Partitioning and solubilizing the catalyst nano-particles from the hydrocarbon stream into water is considerably easier when the hydrocarbon phase density is lower and different enough from that of water. This has a positive impact in the simplicity of the separation method needed for the nanoparticles separation from the processed gasoil of this invention. The hydrocarbon products from the gasoil conversion unit are mixed with the ones coming from the topping unit to make them even lighter, then they are water washed/decanted and then mixed back with the unprocessed heaviest fraction of the heavy hydrocarbon mixture, which is the one coming from the bottom of the vacuum distillation column. The final product from this original process scheme is now a low viscosity and density hydrocarbon mixture, suitable for pipeline (or shipment) transportation. When processed in this manner, the heavy hydrocarbon mixture is stable and withstands practically any blending. This process of enhancing transportability of the heavy hydrocarbon mixture does not produce undesirable by-products such as solid coke or unstable asphaltenes, which are typical products of thermal processing.

Catalysts: Nano-Catalysts for Enhanced Dispersion

The chemistry of the processes described may require a catalyst that can be converted into a nano-catalyst by using the high acidity of naphthenic oils and effective mixing to achieve better catalysts than the ones described in U.S. Pat. Nos. 5,688,395, 5,688,741 and 5,885,441. Evidence of the particle formation and size was not provided in the previous art (U.S. Pat. No. 6,043,182), in fact it is described that the method of preparation led to the formation of oil soluble catalytic precursors. The subject invention may utilize rare earth oxides such as Ceria, as well as group IV metals such as Zr oxide and Ti oxide and mixtures thereof combined with NiO, CoOx, alkali metals and $MoO_3$ particles.

Preferably, the nano-catalyst for this invention is produced in a defined nano particle range. When processing lighter oils such as AGO+VGO and DAO, both having a much reduced viscosity with respect to vacuum residue, the suspension and therefore transportability of the catalyst particles to the reactor and throughout the pipelines of the upgrading facility cannot generally be done unless the particles are of well controlled and much lower size than the previous art allowed. This knowledge made possible the invention of a different and optimized catalyst preparation method. Literature data shows that suspension of catalyst particles is feasible in viscous media such as bitumen and heavy oils with particle sizes lower than about 250 nm (H. Loria et al. Ind. Eng. Chem. Res. 2010, 49, 1920-1930 "Model To Predict the Concentration of Ultradispersed Particles Immersed in Viscous Media Flowing through Horizontal Cylindrical Channels"). When lower viscosities of feedstock for processing are used, suspension becomes more restricted; and achieving a particle size lower than 120 nm is important.

For example, a batch of dispersed catalyst was prepared according to the process of U.S. Pat. No. 6,043,182. A VGO was heated to 90° C. (no surfactant added), a Potassium Hydroxide aqueous solution was added while stirring at 1000 rpm for 5 min, and then a solution of Nickel Acetate was added. The resulting emulsion was heated at 330° C. for an hour. The concentration of the Potassium Hydroxide and Nickel Acetate were such that the final product had 830 ppm of Potassium and 415 ppm of Nickel. Dynamic Light Scattering of the resulting suspension is presented in FIG. 8.

Figure 8:
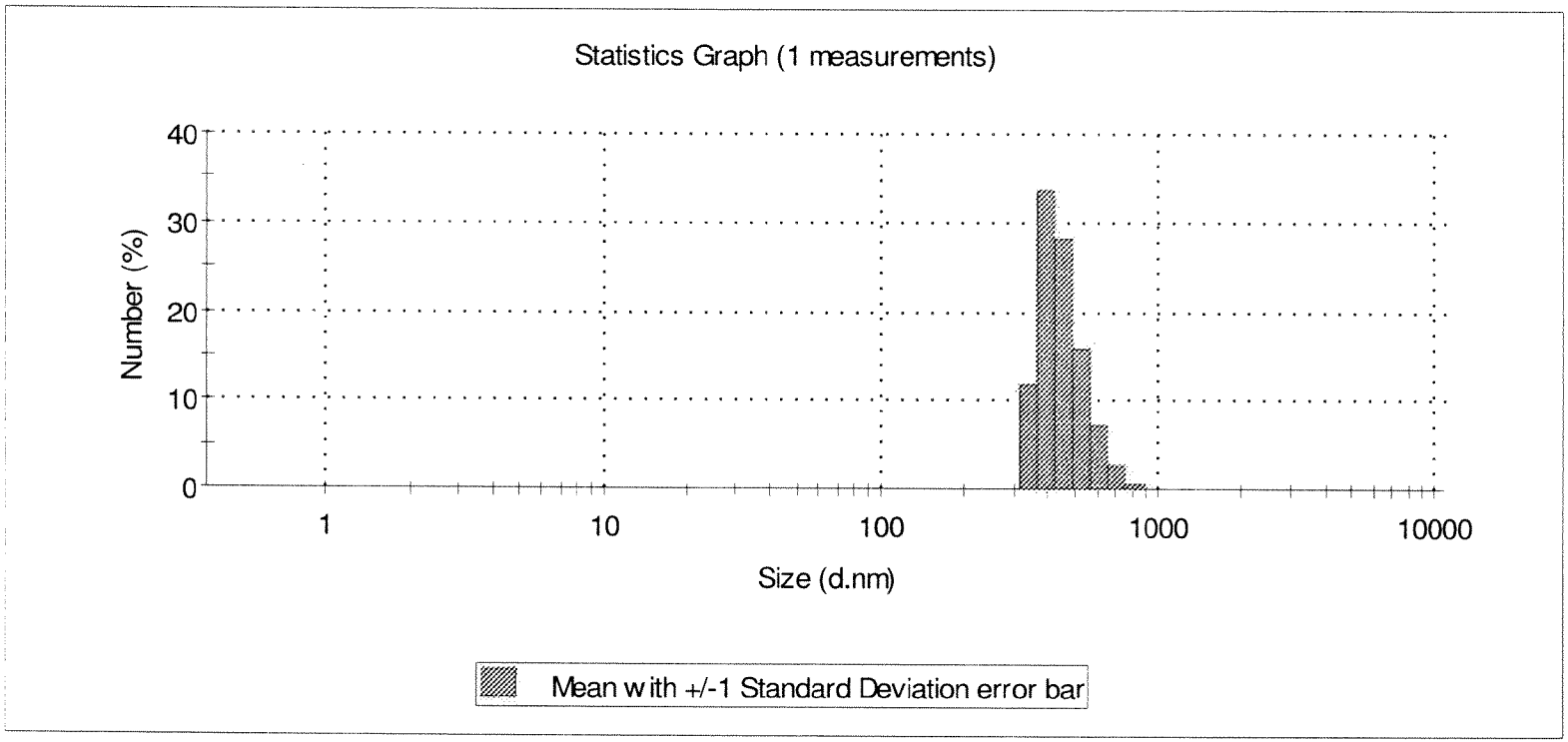
FIG. 8 (PRIOR ART)
FIG. 8 is a graph showing the statistical dispersion of catalyst particles having an average particle size of 400 nm in a vacuum gasoil mixture according to the catalyst preparation method of U.S. Pat. No. 6,043,182.

The particle sizes achievable when using the methods of previous art are therefore in the range of 200-800 nm as shown in FIG. 8.

It is also an object of this invention to provide a method for the preparation of a more convenient catalyst, preferably a nano-catalyst, for the full range gasoil conversion unit as well as for the DAO conversion unit. The nano-catalyst of the present invention is prepared by pre-mixing an alkali solution, either inorganic or organic such as an oleate with a transition metal inorganic salt or an organo-soluble salt to form a stream enriched in both metals. High energy pre-mixing (higher than 400 rpm, more preferably higher than 700 rpm) is needed for incorporating water solutions into the oil fractions, thus ensuring an intimate contact between the hydrocarbons to be processed according to the reaction:

$$H^{+}\text{-}A^{-}\text{-}HC + K^{+}\text{-}(R^{-})\ [(R)\text{ being } OH^{-} \text{ or } O^{-}OC\text{—}HC] \rightarrow K^{+}\text{-}A^{-}\text{-}HC + HOH \text{ or } HOOC\text{—}HC \ldots$$

Based on the titration reaction above and the ranges of the formulations screened (300-2000 ppmw of alkali metal in the feedstock to be processed), an acidity higher than 2 mg of K/g oil assures the incorporation of up to 2000 ppmw of K within the transient emulsion. On average most AGO+VGO streams of heavy oils present acidity higher than 2 mg of K/g oil.

Since the newly-formed potassium salt has surfactant properties, the two metals, alkali and transition metal get intimately close by intense stirring. The alkali metal places itself at the interface of the sub-micronic water drops transiently formed by the intense stirring energy of the solution with the oil; Ni salts, pre-dissolved within the water of the transient emulsion being formed is surrounded by that interface rich in the alkali metal. A fast decomposition immediately follows and a nano-dispersion of the catalyst is achieved.

The surfactant mixture as carefully formulated in order to have the right Hydrophilic-Lipophilic Balance (HLB) for this application. Differently from previous inventions, the addition of the surfactant allows the preparation of nanoparticles even when using feedstocks with low or no acidity.

No formal emulsions are required with this method and with the streams processed under the schemes of this invention such as gas oil of significant acidity and DAO, as it is the case in Canadian Patent No. 2,233,699 where steam cracking is applied only to processing residuals.

The process to manufacture the nano-catalyst uses a high temperature decomposition-high flow rate zone added to the emulsioning method described in prior art discussed above (Intevep's patent on catalytic steam cracking). By inserting this zone in the manufacturing unit, lower particle diameter and in turn higher activity per unit mass of catalyst produced are achieved. Lower particle diameters are obtained due to a relatively short lived micro emulsion formed and substantially immediate decomposition thereof.

By minimizing the time between emulsioning and decomposition we found that the transient, still evolving emulsion, still a micro emulsion, decomposes into particles of much smaller size, in the nano-particle range (less than about 250 nm, preferably from about 20 nm to about 120 nm, more preferably from about 60 nm to about 90 nm,) described herein. The prior art process results in particles sizes much greater (600 nm) than that achieved herein.

Having the decomposition zone incorporated into the catalyst manufacturing unit makes therefore an important, relevant difference with respect to previous art in which the catalyst decomposition time is less controlled, adversely affecting the particle size (depending on the flow rate of the main stream into which the emulsion stream is mixed with, the temperature of the mixing point and beyond, and the distance between the emulsioning and the mixing point and the temperature in between. The method we developed assures a minimal distance and a sharp temperature rise to the decomposition temperature therefore achieving a much reduced particle size, resulting in nano-catalysts for use in catalytic steam cracking.

Some examples are offered hereunder for a better illustration of the present invention.

EXAMPLE 1

Following the scheme represented in FIG. 5, which is applicable to heavy oils and/or bitumens having a high content of AGO and VGO fractions, the following experiment was performed.

2000 g of bitumen having an API gravity of 10.8 (Table 2) was fractionated to produce the AGO-VGO mixture to be used as feedstock for the present invention.

TABLE 2

Fractionation yields from bitumen used for Example 1

| Cuts distribution | Yield, wt % |
|---|---|
| Naphtha (IPB-250° C.) | 6.69 |
| AGO-VGO (250-530° C.) | 49.15 |
| VR (>530° C.+) | 44.16 |

Catalyst Preparation Step

Figure 9:
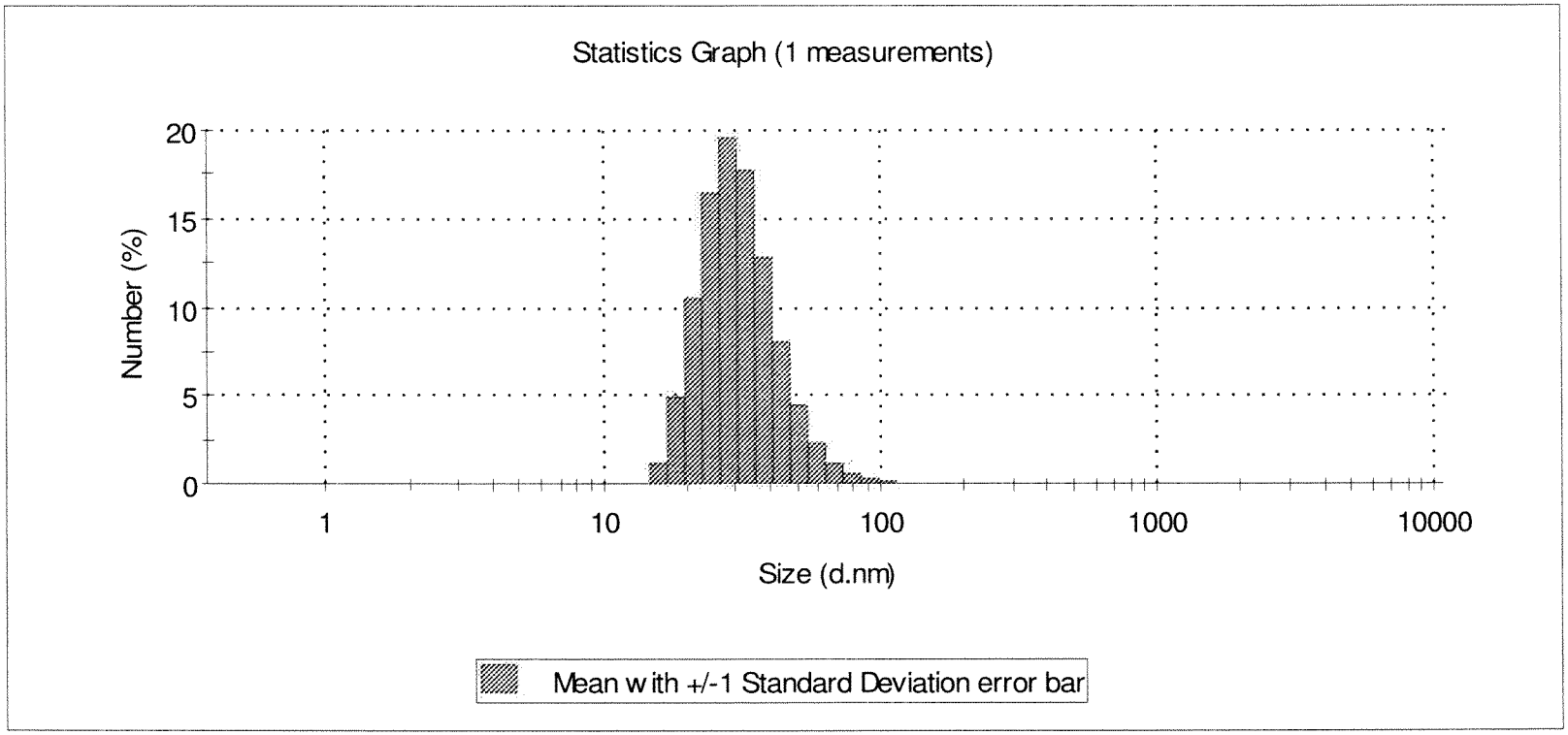
FIG. 9 is a graph showing the statistical dispersion of catalyst nano-particles having an average particle size of 28 nm in an atmospheric gas oil and vacuum gasoil mixture according to a catalyst preparation method using the stream processed under the methods in accordance with the invention.

A Ni—K metallic suspension was prepared in a continuous flow system. In this preparation 200 g of A&VGO feedstock was used. The feedstock was first admixed with a surfactant mixture (TWIN 80 and SPAN 80) in order to have about 0.5 wt % of surfactant. Then, aqueous solutions of Potassium Hydroxide and Nickel Acetate were consecutively added and the resulting stream was passed through a dehydration/decomposition tubular reactor where the residence time was 0.5-2 min. The proportions and concentration of the Potassium Hydroxide and Nickel Acetate solutions were such that the final suspension had 800 ppmw of K and 400 ppmw of Ni. The resultant nano-particles ranged from 20 up to 110 nm with an average particle size of 28 nm, as shown in FIG. 9.

Catalytic Steam Cracking Step

A feedstock for processing in the CSC reactor was prepared by suspending 715 pmw of NiK catalyst into the AGO-VGO mixture using the catalyst preparation unit. The reactor for this experiment was as follows: feedstock from the feed tank was fed into the unit where a positive displacement high precision pump delivered the desired flow at the operating pressure. Nitrogen was used before each run to create an inert atmosphere and to adjust the pressure of the system, which was controlled through a backpressure valve. The feed pumped was first passed through a preheat section where the temperature was raised to the range of 100 to 380° C. before entering the reaction zone. To reach the water to hydrocarbon ratio in the reactor, steam injection was located just before the reactor inlet and was adjusted according to the research requirements. A tubular up flow reactor was installed in the reaction zone with 103 cc of volume capacity. Once at the inlet of the reactor, temperature of the stream was increased to that of the test right at the entrance of the reactor, assuming an isothermal operation throughout the length of it.

The effluents from the reactor went to the collection zone, reaching first a hot separator, where the temperature of the heavy product was controlled at will in the range of room temperature to 260° C. The non-condensed light products coming from the reactor and hot separator were sent through a water-cooled single tube heat exchanger and then directed to the cold separator where the condensed light fraction was collected. Non-condensable vapors (mainly $C_1$-$C_5$ hydrocarbons, $H_2$, CO, $CO_2$ and traces of $H_2S$) passed through the backpressure valve, which controlled a constant pressure in the unit ranging from 0 to 500 psig. Non-condensable gases leaving the cold separator were passed through the gas flow meter (wet test meter), a fraction of the gas flow was sent to the gas chromatograph for compositional analysis.

After a reaction at temperature 440° C., pressure 400 psig and LHSV 2 $h^{-1}$ an upgraded liquid product exhibiting a lower viscosity and a higher API gravity (Table 3) was recovered.

TABLE 3

Characteristics of CSC upgraded product from Example 1

| Hydrocarbon | Feedstock | Liquid product after separation |
|---|---|---|
| Cuts distribution, wt % | | |
| IPB-250° C. | 0.0 | 11.0 |
| 250-530° C. | 100.0 | 84.5 |
| >530° C.+ | 0.0 | 5.5 |
| Viscosity, cP | | |
| @ 25° C. | 173 | 17.8 |
| @ 40° C. | 60.8 | 12.0 |
| API gravity, ° | 16.6 | 19.8 |
| Bromine number | 14.5 | 25.3 |

Recombination Step

The recombination step was needed in order to determine the final properties of the upgraded oil, therefore wherein the embodiment of the present scheme 30 g of synthetic upgraded oil SUO-1 was prepared by combining 3.98 g of light distillates (IBP-250° C.), 13.94 g of upgraded product from the CSC reaction, and 12.09 g of vacuum residue (>530° C.). The resulting SUO has the properties as specified in Table 4.

TABLE 4

Properties of the synthetic upgraded oil obtained from processing scheme depicted in FIG. 5.

| Hydrocarbon | Feed to Scheme of FIG. 5 | SUO-1 |
|---|---|---|
| Viscosity @ 40° C., cP | 2,320 | 178 |
| Viscosity @ 25° C., cP | 8,922 | 470 |
| API gravity, ° | 10.9 | 15 |
| $P_{value}$ (stability parameter) | — | >1.3 |

EXAMPLE 2

According to the embodiment described in FIG. 6, scheme 2 is applicable to heavy oils and bitumen with high content of vacuum residue (Table 5). Thus, the light fraction (naphtha type) was separated from the bitumen using a topping unit; said topped bitumen was subject of a deasphalting process from which the asphaltene-rich fraction (pitch) was collected while the DAO fraction was used as feedstock in the CSC-reaction type of processing as already described in EXAMPLE 1.

715 ppmw of NiK catalytic nano-particles were suspended in the DAO feedstock and processed at a temperature 435° C., pressure 400 psi and LHSV 2 $h^{-1}$. After reaction the liquid products were collected, analyzed and treated to produce the corresponding mass balances in order to recombine the synthetic upgraded oil (SUO-2). The properties of the resulting SUO are presented in Table 5.

TABLE 5

Properties of the synthetic upgraded oil obtained from processing scheme depicted in FIG. 6.

| Hydrocarbon | Feed to Scheme of FIG. 6 | SUO-2 |
|---|---|---|
| Viscosity @ 40° C., cP | | 82 |
| Viscosity @ 25° C., cP | | 166 |
| API gravity, ° | 9.2 | 16.5 |
| $P_{value}$ (stability parameter) | | >1.3 |

EXAMPLE 3

According to the embodiment described in FIG. 7, scheme 3 is applicable to heavy oils and bitumens aiming for the production of the highest API gravity and lowest viscosity achievable with performance beyond transportability goals. In this case, a bitumen type hydrocarbon (Table 6) was fractionated to produce: naphtha, AGO-VGO mixture, and VR fractions. Both the AGO-VGO mixture and the VR fraction were processed in order to maximize upgrading while preserving stability by not cracking heavy molecular weight compounds, i.e. asphaltenes. In this preferred embodiment, the AGO-VGO mixture was reacted in the presence of steam and suspended nano-particles (as detailed in EXAMPLE 1) to produce light oils from the CSC reaction; whereas the VR fraction was subjected to a deasphalting processing in order to generate deasphalted vacuum residue (DAO-VR) and pitch. The DAO-VR was then CSC processed as already described in EXAMPLE 2. The properties of the resulting SUO-3 are presented in Table 6.

TABLE 6

Properties of the synthetic upgraded oil obtained from processing scheme depicted in FIG. 7.

| Hydrocarbon | Feed to Scheme of FIG. 7 | SUO-3 |
|---|---|---|
| Viscosity @ 40° C., cP | | 53 |
| Viscosity @ 25° C., cP | | 100 |
| API gravity, ° | 9.2 | 17.1 |
| $P_{value}$ (stability parameter) | | >1.3 |

Eliminating the Need for Hydrotreating by Using Nano-Catalysts for CSC

It is another objective of this invention to provide a means to incorporate hydrogen into the products of the gasoil and SDA steam catalytic cracking unit as to further ensure the stabilization of the light hydrocarbons produced during the gasoil conversion unit. Since one of the chemical species making up the catalytic nano-particles are of a hydrogenating class (Ni, Co, Mo), the hydrogen produced in the process is purposely passed continuously from the bottom of the gas separator to the top so as to provide hydrogenation of eventual olefins produced during the cracking of gasoil. As the temperature in the hot separator is in the range of 300° C. and the pressure ranges between 320 and 600 psi, the hydrogenating transition metal fulfills the role of catalyst for converting olefins and diolefins into paraffins, eliminating the need for hydrotreating to stabilize the hydrocarbon mixture, as it is needed in thermal cracking processes.

The Heaviest Hydrocarbons as Fuel in the Processing Schemes of the Methods

In another objective of this invention a fraction of the heaviest hydrocarbon from the heavy hydrocarbon mixture (either pitch from the deasphalting unit, or vacuum residue from the vacuum distillation unit) is used to provide the heating needs of the process to eliminate the need for fuels that are difficult to access in remote areas. This energetic sufficiency also optimizes the quality of the resulting hydrocarbon mixture, which will contain a lower proportion of residual and asphaltenes. The resulting synthetic hydrocarbon mixture will then have a lower proportion of fully stable asphaltenes in the residual fraction.

Figure 10:
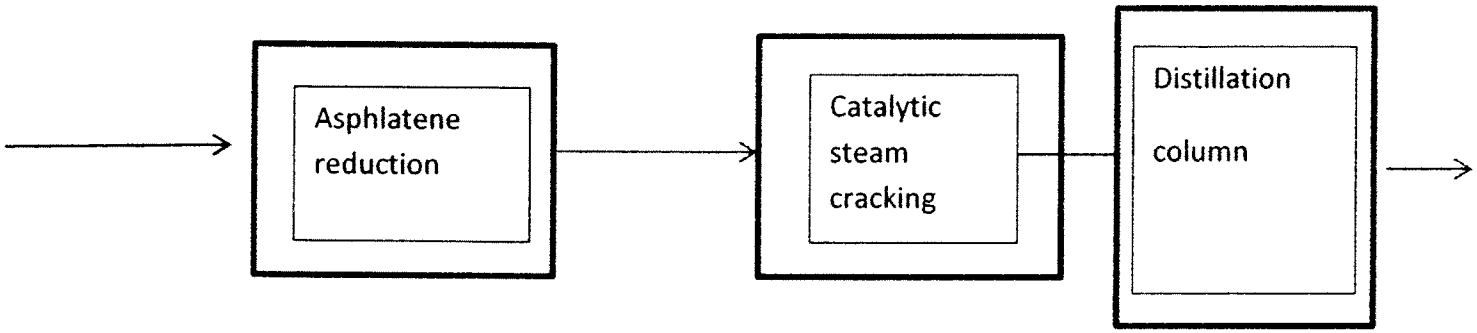
FIG. 10 is a block diagram showing the process according to one embodiment of the invention for the processing of upgrading heavy hydrocarbons from a reservoir comprising reducing the asphaltene content of said heavy hydrocarbons, treating said reduced asphaltene containing heavy hydrocarbon to catalytic steam cracking, and distilling said steam catalytic cracked heavy hydrocarbon, and recovering said upgraded heavy hydrocarbon.

Referring now to FIG. 10, there is shown a heavy hydrocarbon feed whose asphaltene content is reduced by conventional means and subjected to catalytic steam cracking and then subjected to distillation where the distillate is collected thereafter resulting in an upgraded hydrocarbon.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A process for upgrading heavy hydrocarbon mixtures comprising the steps of:

a) separating the heavy hydrocarbon mixture into a light fraction, a full gasoil fraction and a vacuum residue fraction;

b) adding a catalyst to the full gasoil fraction and subjecting the catalyst-full gasoil fraction to catalytic steam cracking to form an effluent stream;

c) separating the effluent stream into a gas stream and a liquid stream;

d) deasphalting the vacuum residue fraction from step a) to form a deasphalted fraction and an asphaltene-rich fraction;

e) splitting the asphaltene-rich fraction from step d) into at least a first asphaltene-rich stream and a second asphaltene-rich stream, wherein the first asphaltene-rich stream is used as fuel; and f) mixing the liquid stream with the light fraction and the second asphaltene-rich stream to form an upgraded oil.

2. The process of claim 1 further comprising between step c) and d) the steps of:

i) adding a second catalyst to the deasphalted fraction and subjecting the deasphalted fraction to catalytic steam cracking to form a light product stream;

ii) separating the light product stream into a second gas stream and a second liquid stream; and wherein the second liquid stream is added to the mixture of in step f) to form the upgraded oil.

3. The process of claim 1 or 2 wherein the effluent stream is separated in step c) by hot separation.

4. The process of claim 1 further comprising the step of recovering the catalyst from step b).

5. The process of claim 2 further comprising the step of recovering the second catalyst from step i).

6. The process of claim 4 or 5 wherein the catalyst is recovered by hydrostatic decanting.

7. The process of claim 1 or 2 wherein the heavy hydrocarbon mixture is selected from any one or a combination of the following: heavy crude oils, distillation residues and bitumen.

8. The process of claim 1 or 2 wherein the upgraded oil has a API gravity of equal to or greater than 15° API.

9. The process of claim 1 or 2 wherein the upgraded oil has a viscosity of equal to or less than 350 cP at 25° C.

10. The process of claim 1 wherein the full gasoil fraction has an initial boiling point (IBP) between 210 and 570° C.

11. The process of claim 1 or 2 wherein the catalyst is a fixed bed catalyst or a nano-catalyst.

12. The process of claim 11 wherein the catalyst comprises any one or a combination of the following: rare earth oxides, group IV metals, NiO, CoOx, alkali metals and $MoO_3$.

13. The process of claim 12 wherein the particle size of the catalyst is equal to or less than 250 nm.

14. The process of claim 13 wherein the particle size of the catalyst is equal to or less than 120 nm.

* * * * *